United States Patent [19]

Chalmers, II

[11] 4,398,359

[45] Aug. 16, 1983

[54] PLASTIC SKI BOOT

[75] Inventor: Edward L. Chalmers, II, Boulder, Colo.

[73] Assignee: Lange International S.A., Fribourg, Switzerland

[21] Appl. No.: 237,436

[22] Filed: Feb. 23, 1981

[51] Int. Cl.[3] ..... A43B 5/04

[52] U.S. Cl. ..... 36/117

[58] Field of Search ..... 36/117

[56] References Cited

U.S. PATENT DOCUMENTS

| | | | |
|---|---|---|---|
| 3,834,723 | 9/1974 | Erlebach | 36/117 |
| 3,957,280 | 5/1976 | Turnheim et al. | 36/117 |
| 4,245,409 | 1/1981 | Beyl | 36/117 |
| 4,335,531 | 6/1982 | Salomon | 36/117 |

*Primary Examiner*—Patrick D. Lawson

*Attorney, Agent, or Firm*—Brumbaugh, Graves, Donohue & Raymond

[57] ABSTRACT

A plastic ski boot having an attachment member mounted on its lower between the toe and heel, is adapted to be releasably attached to a ski. The toe and heel portions of the boot are shaped to facilitate safe and comfortable walking and standing, and at least part of the sole walking surfaces are covered with a high friction plastic for walking purposes. The forward lean angle of the boot when out of the binding can be lesser than normal to provide comfortable standing and walking, and the ski binding with which the boot is adapted to cooperate adds sufficient forward lean angle for skiing purposes when the boot is in the binding.

18 Claims, 3 Drawing Figures

PLASTIC SKI BOOT

The present invention relates to a plastic ski boot adapted to be releasably attached to a ski and, when out of the ski binding, facilitating safe and comfortable standing and walking by the wearer.

BACKGROUND OF THE INVENTION

Modern ski boots formed of plastic materials have provided, when releasably attached to skis, greatly improved control and performance. Difficulties have, however, been encountered when walking or standing with plastic boots due to the configuration and low friction characteristics of their lowers required for conventional bindings, and further due to the stiffness and required forward lean angle built into the boots. In other words, the specific boot characteristics required for conventional toe and heel ski bindings render the boots unsuitable for safe and comfortable walking or standing.

To provide safer walking characteristics, attachments have been devised to clip on to boot lowers for changing the sole configuration and providing a non-slip walking surface. Such clip on arrangements are bulky to carry, difficult to attach to the boot when at the mountain in cold weather, and hence have not found wide use.

SUMMARY OF THE INVENTION

The present invention provides a plastic ski boot which can be both releasably attached to a ski and safely and comfortably used for walking by the wearer. To provide these advantageous characteristics, the inventive ski boot includes a binding attachment member mounted on the boot lower between the toe and heel. In addition, plastic on the sole assists in spacing the attachment member from the toe and heel walking surfaces. In one embodiment, the plastic is a high friction walking material provided on the walking surfaces of the boot.

Rather than using the sole extensions fore and aft and an essentially flat sole required by applicable standards for conventional toe and heel bindings, the inventive boot incorporates an upwardly curved toe portion and a beveled heel portion which, together with the high friction walking material, renders the inventive ski boot safe and comfortable for walking purposes. Transverse ridges formed in hard plastic at the curved and beveled portions can be used to increase the boot's bite into hard snow and ice, further increasing its safety.

Another embodiment incorporates a boot upper and lower formed with a lesser forward lean angle for comfortable standing and walking. When attached to a ski, a ski binding cooperates with the attachment member on this boot embodiment to provide a proper forward lean angle for skiing.

The invention will be better understood when the following description is read in connection with the accompanying drawings.

DETAILED DESCRIPTION

Figure 1:
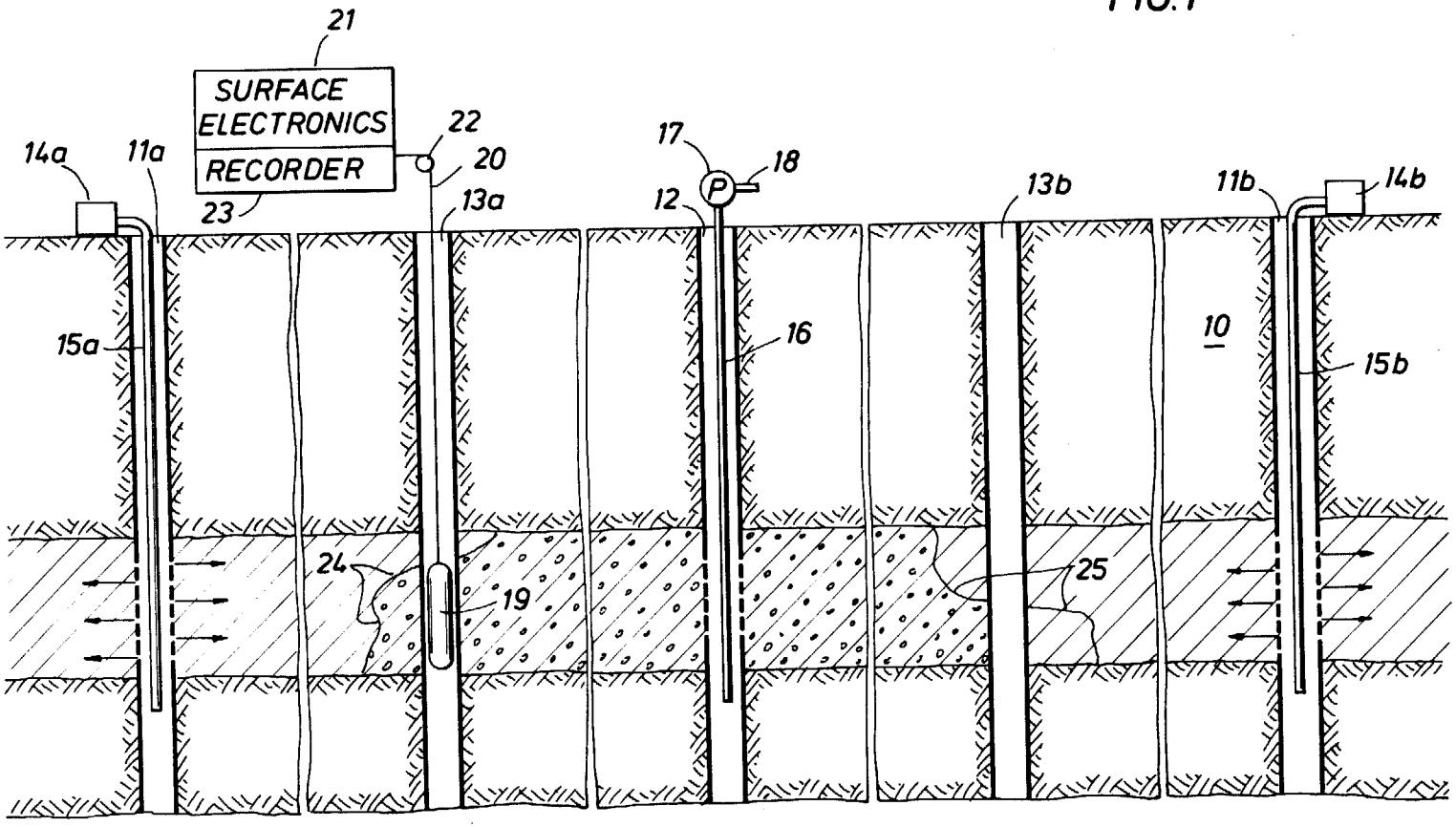
FIG. 1 illustrates a plastic ski boot incorporating the invention and suitable for releasable attachment to a ski and for standing and walking.
Figure 2:
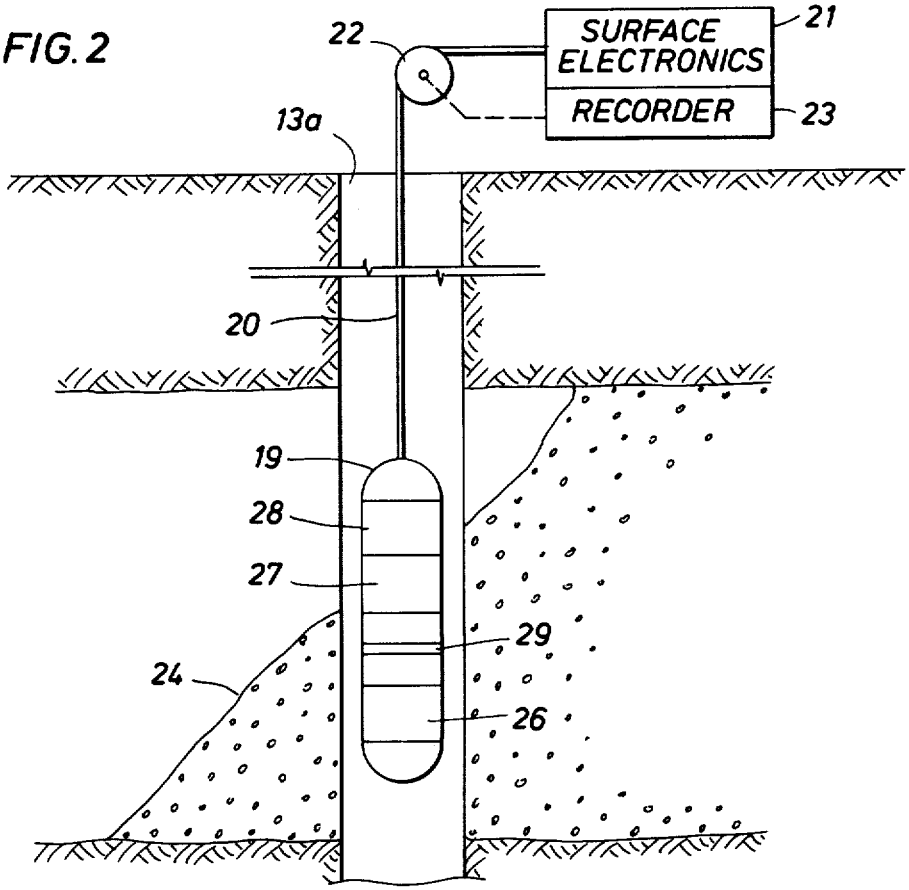
FIG. 2 is a cross-sectional view of the boot shown in FIG. 1, partially broken away, on the view line 2—2 in FIG. 3, illustrating the invention in greater detail.
Figure 4:
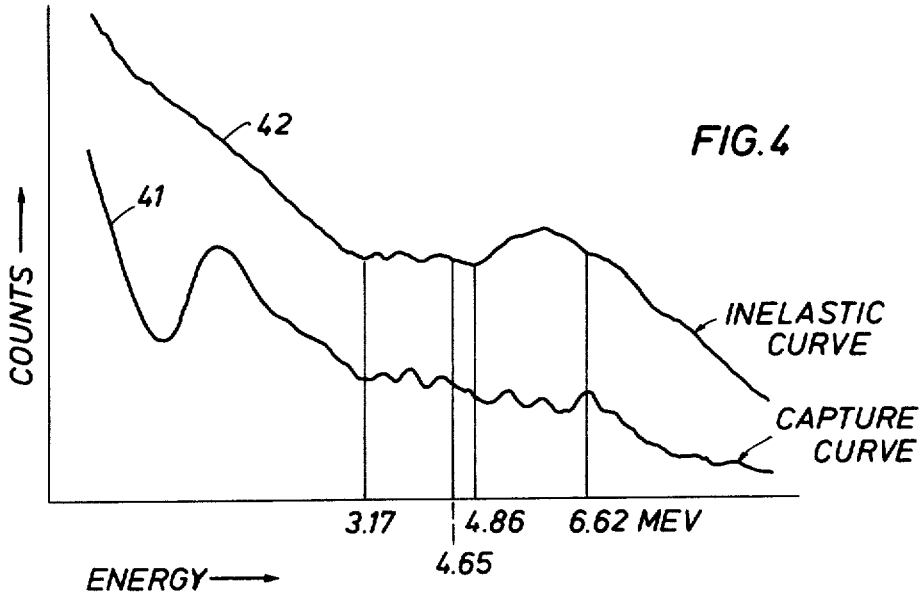

Referring to the invention in greater detail with particular reference to FIG. 1, a plastic ski boot 10 is formed of a boot upper 11 and a boot lower 12 including a sole 13, the upper and lower being adjustably clamped by buckles 14. Mounted on the boot lower 12 is a binding attachment member 15 positioned between the sole toe portion 16 and the sole heel portion 17. Plastic material 18 assists in spacing the member 15 from the toe and heel walking surfaces. Preferably the plastic 18 is formed of a high friction material suitable for walking surfaces, for example a thermoplastic rubber of durometer 60 Shore A can be used. Lesser portions of the boot can be covered by the plastic 18 (FIG. 2), depending on the binding used and the configuration of the boot. Moreover, some or all of the plastic 18 can be low friction material if required by the binding arrangement.

The toe portion 16 is shaped to facilitate walking, here shown with an upward curve. The curve at the toe can be on the order of two inches for small boot sizes to on the order of 3½ inches for larger sizes. The only requirements are sufficient room for the foot, insulation inside the boot, and sufficient flat surface for standing on the binding.

The heel portion is shaped with a bevel for safer and more comfortable walking.

The toe and heel shapes are not in compliance with applicable standards (for example DIN 7880 German Standards) for conventional toe and heel bindings. Such standards require extensions fore and aft of the foot for engagement with such bindings. Such extensions, however, interfere with normal walking and are particularly dangerous on steps and uneven surfaces. With the use of a ski binding engaging and releasably holding the attachment member 15, located between the toe and heel portions, there is no need for the dangerous and unsightly extensions on the boot. Thus the operative contact surfaces of the binding to the boot do not act directly on the boot lower, but act through the attachment member to the boot.

When conventional ski bindings are used, applicable standards require a particular glide friction for the glide region of the boot sole since the boot normally rests on a glide element of polytetrafluoethylene on the ski surface. With the inventive boot, the attachment member remains with the boot, the binding remains with the ski, and the two are attached releasably. Preferably the boot sole is spaced from the ski surface, hence its high friction characteristics do not interfere with binding release.

Figure 3:
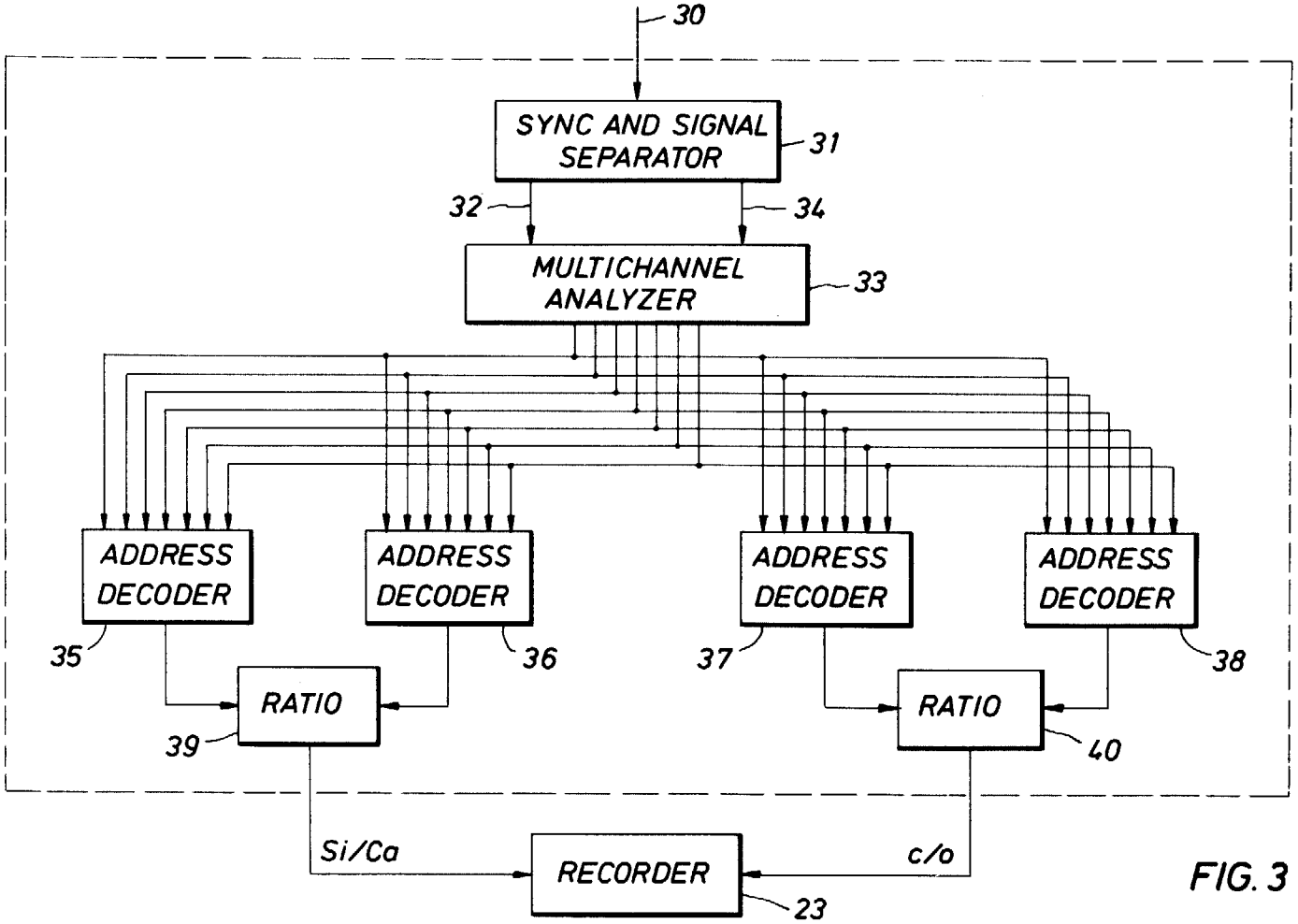
FIG. 3 is a bottom view of the ski boot shown in FIG. 1.
Figure 5:
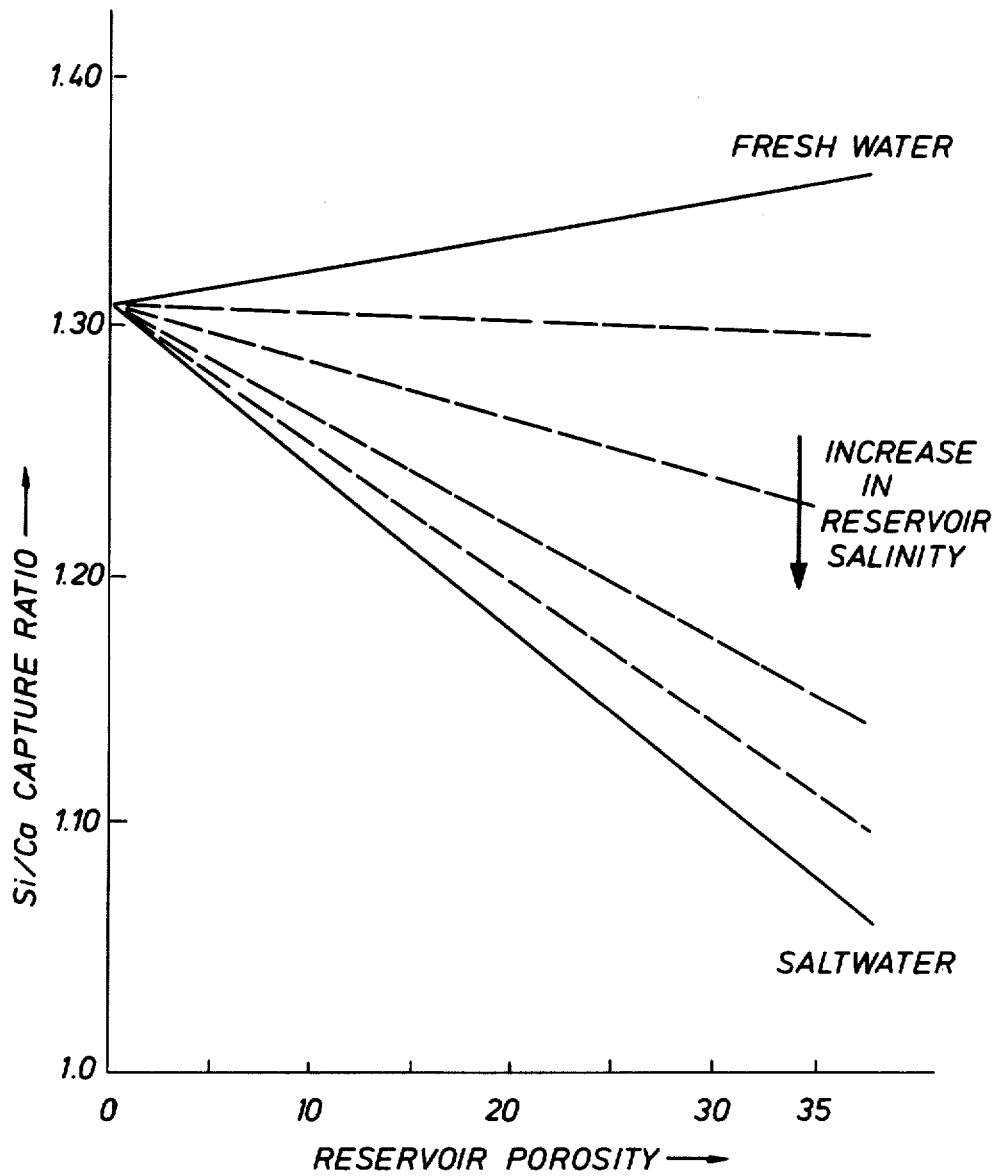

The attachment member 15, best shown in FIG. 3, can be in the form of a flat plate provided with wings 19 on both sides to cooperate with a binding attachment 20 (details not shown) mounted on a binding plate 21 affixed to a ski 22. Flat transverse ridges 21*a* on the plate 21 support the boot 10 when the member 15 is held by the binding attachment 22. Note that the boot 10 is spaced from the surface of the ski 22. The binding releases when forces of a certain magnitude are exerted between the boot and the ski without interference from the small surface areas of contact between the ridges 21*a* and the boot sole 13. If desired, however, low friction material can be used on the boot sole at the areas of contact between the ridges 21*a* and the sole.

The member 15, lightened by an opening 15*a*, is mounted on the boot lower by screws 23 threadedly received by a plate 24, also lightened by openings, embedded in the boot sole 13. With this arrangement, the flexibility of the boot lower can be designed without regard to the torsional, compressional and flexural stiffness requirements of the boots used with conventional toe and heel bindings. Moreover, in addition to the use of high friction walking material on the sole, the toe and heel ends can be made from plastic material harder than normal for boots, for example 45 Shore D to 65 Shore D. The harder toe and heel areas can be formed with sharp toe ridges 16*a* and the sharp heel ridge 17*a* to cause the boot sole to penetrate hard snow and ice, thus increasing walking security.

If a ski binding attachment is used which requires movement between the boot and binding (but not a conventional toe and heel binding), the inventive boot can utilize low friction material where the boot contacts the binding or the ski surface.

Referring to FIG. 1, the boot 10 there shown is formed with the boot upper and lower providing an angle somewhat less than a normal forward lean angle for skiing purposes. The plate 21 is tapered forwardly on the ski to add an additional amount of forward lean for the desired forward lean. The boot when out of the binding is then more comfortable for standing and walking.

In an exemplary embodiment of the invention, a boot upper and lower provide a boot angle of 8 to 10 degrees, a comfortable angle for standing and walking in the boot when out of the ski binding. This should be contrasted with the normal forward lean angles of from 14 to 25 degrees with 16 degrees nominal, all of which provides an uncomfortable standing or walking position. With the boot angle of 8 to 10 degrees, the binding plate 21 can be tapered to provide an additional forward lean angle of on the order of 8 degrees, thus providing a desired forward lean angle with the boot in the binding of from 16 to 18 degrees.

It will be understood that the above described embodiments are merely exemplary and that persons skilled in the art may make variations and modifications without departing from the spirit and scope of the invention. All such modifications and variations are intended to be within the scope of the invention as defined in the appended claims.

I claim:

1. A plastic ski boot adapted to be releasably attached to a ski comprising a boot upper, a boot lower including a sole having a walking surface at least at the toe and heel, a laterally engageable attachment member mounted on the boot lower between the sole toe and sole heel, plastic forming at least part of the sole, wherein the sole plastic defines at least a portion of the walking surface and acts to vertically space said attachment member from the walking surface, said attachment member adapted to be releasably secured to a binding on the ski.

2. A plastic ski boot as defined in claim 1, wherein said sole plastic extends below said attachment member to be interposed between said member and the walking surface, and wherein said sole plastic is at least partially formed of a high friction walking material.

3. A ski boot as defined in claim 2, wherein said attachment member has a pair of laterally spaced portions arranged to cooperate with a ski binding for releasably attaching the boot to a ski.

4. A ski boot as defined in claim 1, wherein the boot upper and lower are formed to provide a comfortable standing angle when the boot is out of the ski binding.

5. A ski boot as defined in claim 4, wherein the attachment member is adapted to cooperate with a ski binding to provide a normal forward lean angle for the boot when it is releasably attached to the ski.

6. A ski boot as defined in claim 1, wherein said attachment member has a pair of laterally spaced portions arranged to cooperate with a ski binding for releasably attaching the boot to a ski.

7. A plastic ski boot as defined in claim 1 or 2, in which portions of the sole toe and the sole heel are shaped to facilitate walking.

8. A plastic ski boot as defined in claim 7, wherein said toe portion is curved upwardly and said heel portion is beveled.

9. A plastic ski boot as defined in claim 8, wherein at least one transverse ridge is provided at one or both of the curved and beveled portions.

10. A plastic ski boot adapted to be releasably attached to a ski, comprising a boot upper, a boot lower including a sole having a walking surface at least at the toe and heel, a plate embedded in the sole, a laterally engageable attachment member mounted on the plate between the sole toe and sole heel, plastic forming at least part of the sole, wherein the sole plastic defines at least a portion of the walking surface and acts to vertically space said attachment member from the walking surface, said attachment member adapted to be releasably attached to a binding on the ski.

11. A plastic ski boot as defined in claim 10, wherein said sole plastic extends below said attachment member to be interposed between said member and the walking surface, and wherein said sole plastic is at least partially formed of a high friction walking material.

12. A ski boot as defined in claim 10, wherein said attachment member has a pair of laterally spaced portions arranged to cooperate with a ski binding for releasably attaching the boot to a ski.

13. A ski boot as defined in claim 11, wherein said attachment member has a pair of laterally spaced portions arranged to cooperate with a ski binding for releasably attaching the boot to a ski.

14. A plastic ski boot as defined in claim 10 or 13, in which portions of the sole toe and the sole heel are shaped to facilitate walking.

15. A plastic ski boot as defined in claim 14, wherein said toe portion is curved upwardly and said heel portion is beveled.

16. A plastic ski boot as defined in claim 15, wherein at least one transverse ridge is provided at one or both of the curved and beveled portions.

17. A ski boot as defined in claim 10, wherein the boot upper and lower are formed to provide a comfortable standing angle when the boot is out of the ski binding.

18. A ski boot as defined in claim 17, wherein the attachment member is adapted to coperate with a ski binding to provide a normal forward lean angle for the boot when it is releasably attached to the ski.

* * * * *